United States Patent [19]

Farjon et al.

[11] 3,944,373

[45] Mar. 16, 1976

[54] PERFORATOR

[75] Inventors: Raymond Farjon; Jacques Farce; Francis Doyelle, all of Boulogne-sur-Mer; Claude Colin, Saint-Martin-Boulogne, all of France

[73] Assignee: Baignol & Farjon S.A., Boulogne-sur-Mer, France

[22] Filed: Feb. 8, 1974

[21] Appl. No.: 440,868

[30] Foreign Application Priority Data

Jan. 4, 1974 France ..... 74.00258

[52] U.S. Cl. ..... 402/1; 30/358; 83/588

[51] Int. Cl.[2] ..... B42F 3/00

[58] Field of Search ..... 402/1, 79, 4; 30/358, 368; 83/467, 588

[56] References Cited

UNITED STATES PATENTS

| | | | |
|---|---|---|---|
| 1,217,870 | 2/1917 | Klaes | 30/358 |
| 1,292,124 | 1/1919 | Stenquist | 30/358 |
| 1,567,374 | 12/1925 | Keene | 402/1 |
| 1,665,805 | 4/1928 | Walter | 83/588 |
| 2,105,233 | 1/1938 | Schade | 402/1 |
| 3,275,003 | 9/1966 | Chamberlin | 402/79 |
| 3,303,564 | 2/1967 | Hendricks | 402/1 X |

FOREIGN PATENTS OR APPLICATIONS

| | | | |
|---|---|---|---|
| 288,444 | 5/1953 | Switzerland | 402/1 |

*Primary Examiner*—Jerome Schnall

*Attorney, Agent, or Firm*—Cooper, Dunham, Clark, Griffin & Moran

[57] ABSTRACT

A perforator of the kind having a die and a slidable punch for piercing holes in sheets of paper or similar documents intended to be placed in a file or binder with openable rings. The perforator is constructed so that it can be temporarily fitted to each ring of the file or binder for the purpose of piercing a hole accurately aligned with the ring.

3 Claims, 4 Drawing Figures

PERFORATOR

The present invention relates to a perforator of the kind which is used for piercing holes in sheets of paper or other documents which it is desired to file away.

Binders or files are known which have openable rings which permit the collection of sheets of paper therein provided that the latter have been appropriately perforated. These files or binders are made in many diverse forms which differ one from another, especially as regards the number of rings and the spacing, diameter and thickness of the latter.

Naturally, there is found in industry, although not always easily, pre-perforated sheets which correspond to the various types of files or binders, but the user has great difficulty when he needs to file a sheet or document which has not been pre-perforated. He must therefore have at his disposal a multiple hole perforator corresponding to the file or binder which he uses — which is not generally the case — or else he must form one by one, with the aid of a single hole perforator, the necessary perforations.

With a single hole perforator, the user generally proceeds in the following manner: he places the sheet to be perforated at the edge of the file or binder with openable rings and he marks on the said sheet, with pencil, the position of each of the rings. He then introduces the sheet marked in this way into the perforator and tries to centre in a suitable way the first mark with respect to the die of the perforator, pierces the hole and proceeds in the same manner for the other hole or holes. This method of operation is inconvenient and it rarely gives good results.

The present invention has for its object essentially to improve a perforator in such a way that it is possible, easily and without previous marking, to pierce a sheet of paper or other document with holes which correspond appropriately to the rings of a file or binder.

According to the invention, the perforator is conceived and made in such a way as to be capable of being fitted temporarily to each of the rings of the file or binder.

One embodiment of the perforator according to the invention comprises two wings to the rear of the space into which the sheet of paper to be pierced is introduced. These two wings are spaced apart to provide a gap whose median plane passes through the axis of the punch of the perforator and into which a ring of the file or binder can be engaged.

Preferably, these wings are sufficiently thin to enable them to be inserted between the rings of the file or binder when the latter are very close to one another. Furthermore, they are preferably flexible so that the perforator can be fitted to rings of different thickness, while having sufficient rigidity to ensure the maintenance of the apparatus firmly in position.

Figure 1:
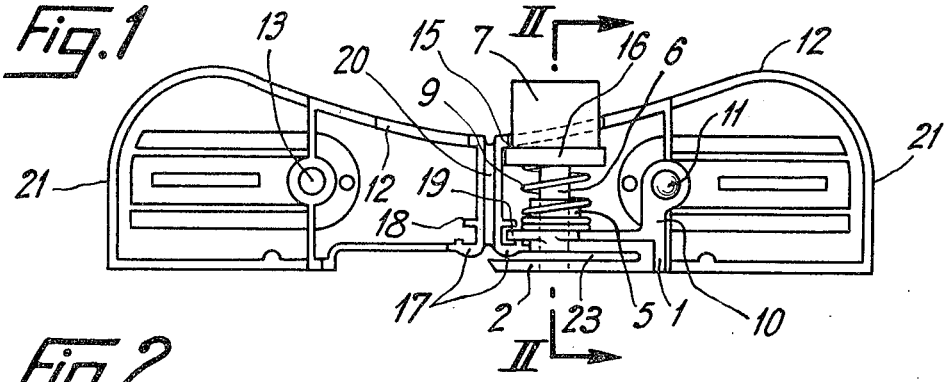
Figure 2:
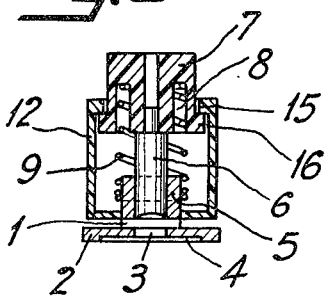
Figure 4:
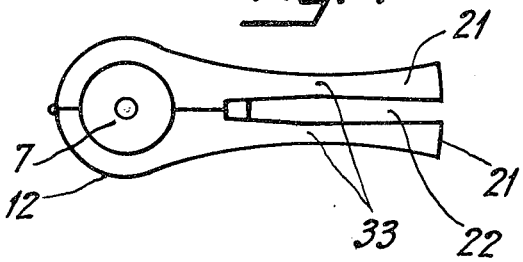
Figure 3:
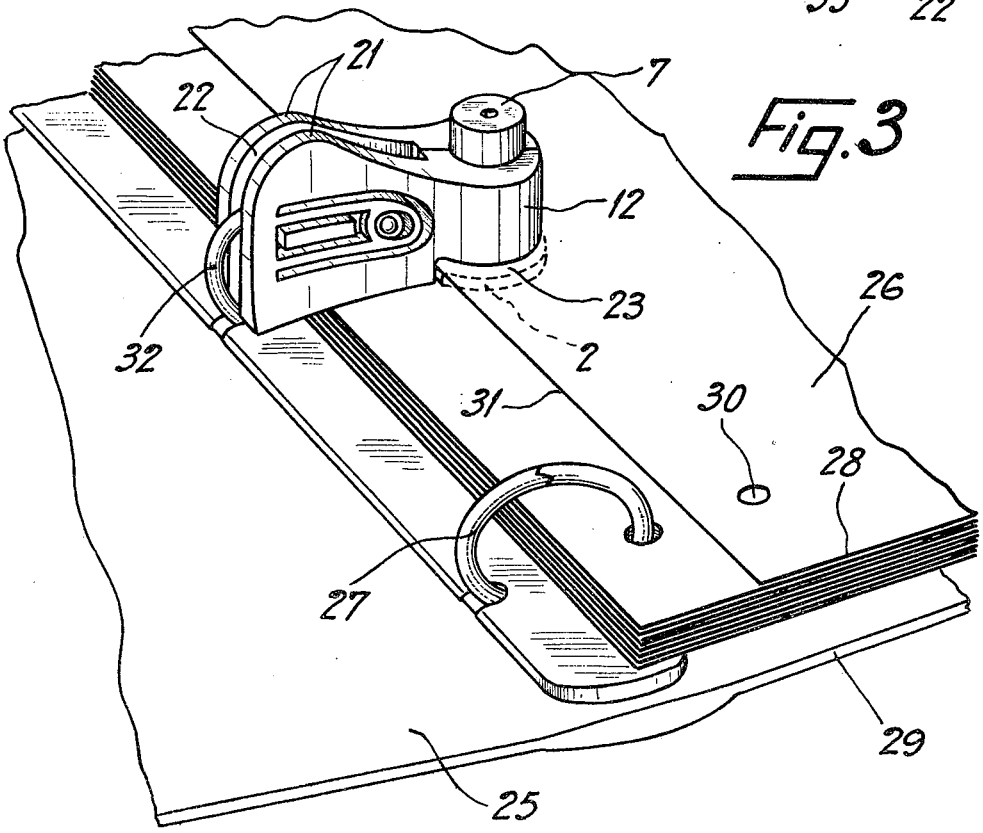

The use of the apparatus is very simple, as will be better understood from the following description of an embodiment of the invention, given by way of example, with reference to the accompanying drawing, in which:

FIG. 1 is a side elevation of one embodiment of a perforator in accordance with the invention with its wings open, FIG. 2 is a section taken along the line II-II of FIG. 1, but with the wings of the perforator in closed position, FIG. 3 is a schematic perspective view illustrating the method of employment of the perforator of FIGS. 1 and 2, and FIG. 4 is a plan of the perforator of FIGS. 1 and 2 with the wings in closed position.

In the embodiment shown in the drawing, the perforator includes a monobloc frame 1 on which is mounted the perforating mechanism. The frame 1 has at its lower part a sole-plate 2 forming the die, this sole-plate being pierced by a hole 3 of the shape it is desired to punch into sheets of paper. The lower face of the sole-plate has a shallow central clearance 4 (see FIG. 2). This lower face of the sole-plate may be designed in order to receive a box (not shown) for collecting the discs of paper produced during perforation of paper sheets.

Above the sole-plate there is provided, in alignment with the axis of the hole 3, a guide sleeve 5 for a punch 6, the latter having a cross-section corresponding to that of the hole 3. At its upper part, the punch has a push-button 7 fixed thereon, the lower face of the latter having an annular recess 8 for the reception of one end of a helical spring 9 which bears at its other end on the frame 1 around the sleeve 5 (see FIG. 1). The spring 9 tends to separate the punch from the die.

The frame 1 also has a lateral cross-head 10 provided, perpendicular to the axis of the punch, with nipples 11 having rounded ends which serve for the fixing of a box 12, for example of synthetic plastics material.

This box is constituted by two casings which are symmetrical with respect to one another and which each have a hole 13 into which the corresponding nipple 11 of the cross-head 10 is resiliently engaged. The nipples 11 may be riveted in order to achieve a rigid assembly.

Each of these casings has a substantially semi-cylindrical body in which the mechanism of the perforator is housed. At its upper part, this body has a flange 15 against which a corresponding collar 16 of the push-button 7 abuts under the action of the spring 9. At its lower part, it has a flange 17 and a step 18 between which a lug 19 of the frame 1 is received so that the mechanism is conveniently fixed in the body (see FIG. 1).

The two casings are hinged one to the other along a generatrix of their semi-cylindrical bodies by means of a hinge 20 formed by a thin strip of the plastics material from which the casings are made.

At its end opposite to the hinge, each casing of the cylindrical body is extended by a relatively thin wing 21, the general plane of which is parallel to the axis of the hinge and to that of the punch.

Each of these wings is suitably reinforced around the hole 13 which serves for its fixing longitudinally to the frame 1, as well as at its edges.

As can be seen especially from FIG. 3, when the casings are closed, there is provided between them a gap 22 to the rear of the space 23 into which the sheet of paper to be pierced is introduced. The median plane of the gap 22 passes through the axis of the punch 3. From FIG. 4 it is apparent how an openable ring of a file or binder can be firmly received between the two wings. Adjacent to the perforating mechanism, the internal faces of the wings converge in such a way that when applied between them, rings of different thicknesses can be positioned without difficulty in the median plane of the gap defined by the wings. Remote from the punching mechanism, the flexibility of the wings allows rings of different thicknesses to be gripped. The wings have a section of least resistance at 33. This section is positioned so that the opening of the wings does not modify the holding of a ring adjacent to the mechanism.

The apparatus which has just been described may be used in the following manner:

The file or binder 25 into which it is desired to file a sheet of paper or document 26 is opened. The perforator, with its casings closed one against the other, is placed astride a first ring 27, so that the latter is engaged in the gap 22. The sheet 26 is then inserted into the space 23 of the perforator so that the lower edge 28 of this sheet occupies the desired position with respect to the lower edge 29 of the file or binder. Whilst maintaining the sheet in place by hand, pressure is applied to the push-button 7 so as to pierce a first hole 30. Then, while continuing to maintain the sheet 26 in place, the perforator is disengaged from the ring 27 and slid along the inner edge 31 of the sheet. The perforator is then mounted on the second ring 32 and the piercing of the second hole is performed.

When the perforation has been completed, the sheet 26 fits without difficulty into the file or binder.

It will be understood that the perforator in accordance with the invention may be used for piercing any suitable holes.

Of course, modifications may be made to the embodiment which has just been described, in particular by the substitution of equivalent technical means without departing from the scope of the present invention.

What is claimed is:

1. A perforator comprising two horizontally spaced and vertically extending symmetrical casings generally vertically joined together at one end thereof and defining therebetween at said one end a body which houses a punch and die for piercing holes in sheets of paper or similar documents, said punch and die having a vertical axis and said punch being disposed in said body for vertical movement along said axis toward and away from said die, said casings each including a wing extending rearwardly from said body opposite said one end, said two casings being joined together adjacent to and rearwardly of said body and adjacent said wings, said wings defining therebetween a vertically disposed narrow gap whose median plane passes through the axis of the punch and die of the perforator and in which a ring of a file or binder may be engaged, said wings being flexible to resiliently engage flatwise the ring of a file or binder which may be positioned within said gap without requiring the opening of the ring so that the hole formed by the perforator will be in line with the plane of the engaged ring.

2. A perforator according to claim 1, in which said punch and die include a frame housed within said body, said frame including a pin which provides said joining together of said casings rearwardly of said body.

3. A perforator according to claim 2, in which each casing, at said one end thereof, is substantially semi-cylindrical, so that said two casings together provide a substantially cylindrical body for housing said punch and die.

* * * * *